US009200474B1

(12) United States Patent
Chen

(10) Patent No.: US 9,200,474 B1
(45) Date of Patent: Dec. 1, 2015

(54) LOCKING DEVICE

(71) Applicant: Yen-Po Chen, Taipei (TW)

(72) Inventor: Yen-Po Chen, Taipei (TW)

( * ) Notice: Subject to any disclaimer, the term of this patent is extended or adjusted under 35 U.S.C. 154(b) by 0 days.

(21) Appl. No.: 14/522,645

(22) Filed: Oct. 24, 2014

(30) Foreign Application Priority Data

May 15, 2014 (TW) ..... 103117128 A

(51) Int. Cl.

| | |
|---|---|
| ***E05B 29/04*** | (2006.01) |
| ***E05B 19/02*** | (2006.01) |
| ***E05B 27/00*** | (2006.01) |
| ***E05B 19/00*** | (2006.01) |

(52) U.S. Cl.

CPC ..... *E05B 27/0057* (2013.01); *E05B 19/0017* (2013.01); *Y10T 70/787* (2015.04); *Y10T 70/7881* (2015.04); *Y10T 70/7898* (2015.04); *Y10T 70/8595* (2015.04); *Y10T 70/8622* (2015.04)

(58) Field of Classification Search

CPC . E05B 29/0033; E05B 29/00; E05B 29/0053; E05B 27/0057; E05B 19/0017; E05B 19/0023; E05B 19/0029; E05B 19/0035; E05B 19/0041; E05B 19/0047; E05B 19/007; E05B 19/0076; Y10T 70/7881; Y10T 70/7898; Y10T 70/787; Y10T 70/8595; Y10T 70/8622

USPC ..... 70/358, 409, 453, 454, 375, 492, 393, 70/395, 403, 404, 407, 400, 401, 412, 419

See application file for complete search history.

(56) References Cited

U.S. PATENT DOCUMENTS

| | | | | | |
|---|---|---|---|---|---|
| 63,230 | A * | 3/1867 | Dickson | 70/150 |
| 424,412 | A * | 3/1890 | Fischer | 70/407 |
| 426,734 | A * | 4/1890 | Mosley | 70/43 |
| 616,751 | A * | 12/1898 | Vedder et al. | 70/493 |
| 842,834 | A * | 1/1907 | Hurdle | 70/473 |
| 958,706 | A * | 5/1910 | Chambless | 70/20 |
| 1,161,760 | A * | 11/1915 | Baird | 70/407 |
| 1,280,633 | A * | 10/1918 | Baird | 70/492 |
| 1,932,706 | A * | 10/1933 | Neer | 70/493 |
| 2,014,112 | A * | 9/1935 | McCord | 70/407 |
| 3,208,248 | A * | 9/1965 | Tornoe | 70/383 |
| 4,454,735 | A * | 6/1984 | Huang | 70/346 |
| 4,512,166 | A * | 4/1985 | Dunphy et al. | 70/366 |
| 4,598,563 | A * | 7/1986 | Berkowitz | 70/492 |
| 5,600,981 | A * | 2/1997 | Sievert | 70/492 |
| 6,758,074 | B1 * | 7/2004 | Prunbauer | 70/366 |
| 6,925,844 | B2 * | 8/2005 | Liu | 70/375 |
| 2004/0172992 | A1 * | 9/2004 | Huang | 70/358 |
| 2008/0236226 | A1 * | 10/2008 | Harper | 70/491 |
| 2009/0025442 | A1 * | 1/2009 | Klein et al. | 70/492 |
| 2009/0266123 | A1 * | 10/2009 | Mueller et al. | 70/348 |

* cited by examiner

*Primary Examiner* — Lloyd Gall

(74) *Attorney, Agent, or Firm* — Nixon & Vanderhye P.C.

(57) ABSTRACT

A locking device includes a lock and a key. The lock includes a housing, a cylindrical core inserted into and rotatable relative to the housing, and a limiting member that is mounted movably between the housing and the cylindrical core to permit or prevent the relative rotation between the housing and the cylindrical core and that extends into a helical keyway formed in the cylindrical core. The key has a helical blade capable of being inserted into the helical keyway to access the limiting member, so as to move the limiting member to permit the relative rotation between the cylindrical core and the housing.

16 Claims, 6 Drawing Sheets

LOCKING DEVICE

CROSS-REFERENCE TO RELATED APPLICATIONS

This application claims priority of Taiwanese Application No. 103117128, filed on May 15, 2014.

FIELD OF THE INVENTION

The invention relates to a locking device, more particularly to a lock and a key.

BACKGROUND OF THE INVENTION

A conventional lock includes a housing, a central cylinder and a plurality of tumbler members. The central cylinder is inserted into the housing, is rotatable relative to the housing, and has a straight keyway that is formed through an insertion end thereof. Each of the tumbler members is mounted movably between the housing and the central cylinder, extends into the keyway, and is operable to move between a holding position, where the tumbler member is inserted into both of the housing and the central cylinder to prevent the relative rotation between the housing and the central cylinder, and a released position, where the tumbler member is retracted into one of the housing and the central cylinder to permit the relative rotation between the housing and the central cylinder.

Each of the tumbler members can be accessed by a straight key blade that is inserted into the keyway, so as to be driven to move to the released position to permit the relative rotation between the housing and the central cylinder. However, the conventional lock is easily picked since a picking tool may be easily inserted into the straight keyway to access the tumbler members.

SUMMARY OF THE INVENTION

Therefore, an object of the present invention is to provide a pick-resistant locking device.

Accordingly, a locking device of the present invention includes a lock and a key. The lock includes a housing, a cylindrical core and a tumbler unit. The housing includes a housing body having an inner surrounding surface that defines an inner space, and a limiting groove that is formed in the inner surrounding surface, and that communicates spatially with the inner space. The cylindrical core extends along a core axis into the housing, is rotatable relative to the housing about the core axis, and has an insertion end, a helical keyway and a retaining groove. The insertion end is retained in the inner space of the housing body. The helical keyway is formed in an outer surrounding surface of the cylindrical core, and extends through the insertion end to form an opening of the insertion end. The retaining groove is formed in the outer surrounding surface of the cylindrical core, and communicates spatially with the helical keyway. The tumbler unit includes a limiting member and a resilient member. The limiting member is mounted to the cylindrical core, is movable relative to the cylindrical core along a limiting axis of the cylindrical core, and has a main body, a limiting projection and a driven section. The main body extends into the retaining groove. The limiting projection projects away from the cylindrical core, and is aligned with the limiting groove in the direction of the limiting axis when the cylindrical core is at a locked position. The limiting projection engages fittingly the limiting groove to prevent the relative rotation between the cylindrical core and the housing when the limiting member is at an engaged position. The limiting projection is disengaged from the limiting groove to permit the relative rotation between the cylindrical core and the housing when the limiting member is at a disengaged position. The driven section extends into the helical keyway. The resilient member is connected to the limiting member for biasing resiliently the limiting member to the engaged position when the cylindrical core is at the locked position, so as to prevent the relative rotation between the cylindrical core and the housing. The key has a grip section for being held, and a blade section that is connected to the grip section. The blade section includes a helical blade capable of being inserted fittingly into the helical keyway via the opening of the insertion end of the cylindrical core to access the driven section of the limiting member when the cylindrical core is at the locked position, so as to drive movement of the limiting member to the disengaged position to permit the relative rotation between the cylindrical core and the housing.

Another object of the present invention is to provide a pick-resistant lock.

Accordingly, a lock of the present invention includes a housing, a cylindrical core and a tumbler unit. The housing includes a housing body that has an inner surrounding surface defining an inner space, and a limiting groove formed in the inner surrounding surface and communicating spatially with the inner space. The cylindrical core extends along a core axis into the housing, is rotatable relative to the housing about the core axis, and has an insertion end, a helical keyway and a retaining groove. The insertion end is retained in the inner space of the housing body. The helical keyway is formed in an outer surrounding surface of the cylindrical core, and extends through the insertion end to form an opening of the insertion end. The retaining groove is formed in the outer surrounding surface of the cylindrical core, and communicates spatially with the helical keyway. The tumbler unit includes a limiting member and a resilient member. The limiting member is mounted to the cylindrical core, is movable relative to the cylindrical core along a limiting axis of the cylindrical core, and has a main body, a limiting projection and a driven section. The main body extends into the retaining groove. The limiting projection projects away from the cylindrical core, and is aligned with the limiting groove in the direction of the limiting axis when the cylindrical core is at a locked position. The limiting projection engages fittingly the limiting groove to prevent the relative rotation between the cylindrical core and the housing when the limiting member is at an engaged position. The limiting projection is disengaged from the limiting groove to permit the relative rotation between the cylindrical core and the housing when the limiting member is at a disengaged position. The driven section extends into the helical keyway. The resilient member is connected to the limiting member for biasing resiliently the limiting member to the engaged position when the cylindrical core is at the locked position, so as to prevent the relative rotation between the cylindrical core and the housing. A blade member is capable of being inserted into the helical keyway via the opening of the insertion end of the cylindrical core to access the driven section of the limiting member when the cylindrical core is at the locked position, so as to drive movement of the limiting member to the disengaged position to permit the relative rotation between the cylindrical core and the housing.

Yet another object of the present invention is to provide a key for use with a pick-resistant lock.

Accordingly, a key of the present invention is adapted for use with a lock. The lock includes a housing, a cylindrical core that extends rotatably into the housing and that has a helical keyway, and a limiting member that is mounted movably between the housing and the cylindrical core. The limiting member has a driven section that extends into the helical keyway, and is movable between an engaged position where the relative rotation between the housing and the cylindrical core is prevented, and a disengaged position where the relative rotation between the housing and the cylindrical core is permitted. The key includes a grip section for being held, and a blade section connected to the grip section and including a helical blade. The helical blade is adapted to be inserted into the helical keyway to access the driven section of the limiting member, so as to drive movement of the limiting member to the disengaged position to permit the relative rotation between the housing and the cylindrical core.

BRIEF DESCRIPTION OF THE DRAWINGS

Other features and advantages of the present invention will become apparent in the following detailed description of the embodiment with reference to the accompanying drawings, of which.

DETAILED DESCRIPTION OF THE EMBODIMENT

Figure 1:
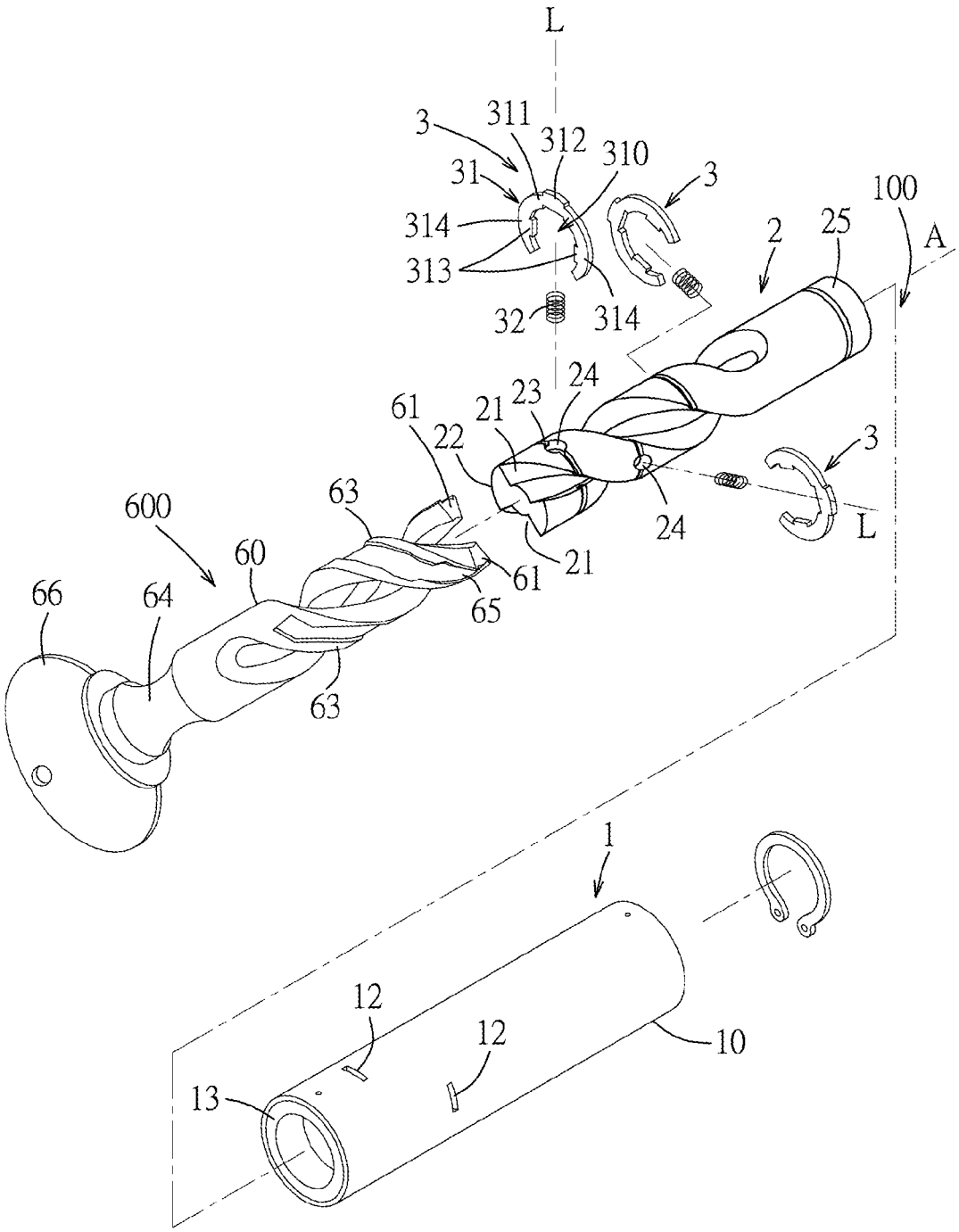
FIG. 1 is an exploded perspective view of an embodiment of a locking device according to the invention.

As shown in FIG. 1, an embodiment of a locking device according to the present invention includes a lock 100 and a key 600.

Figure 2:
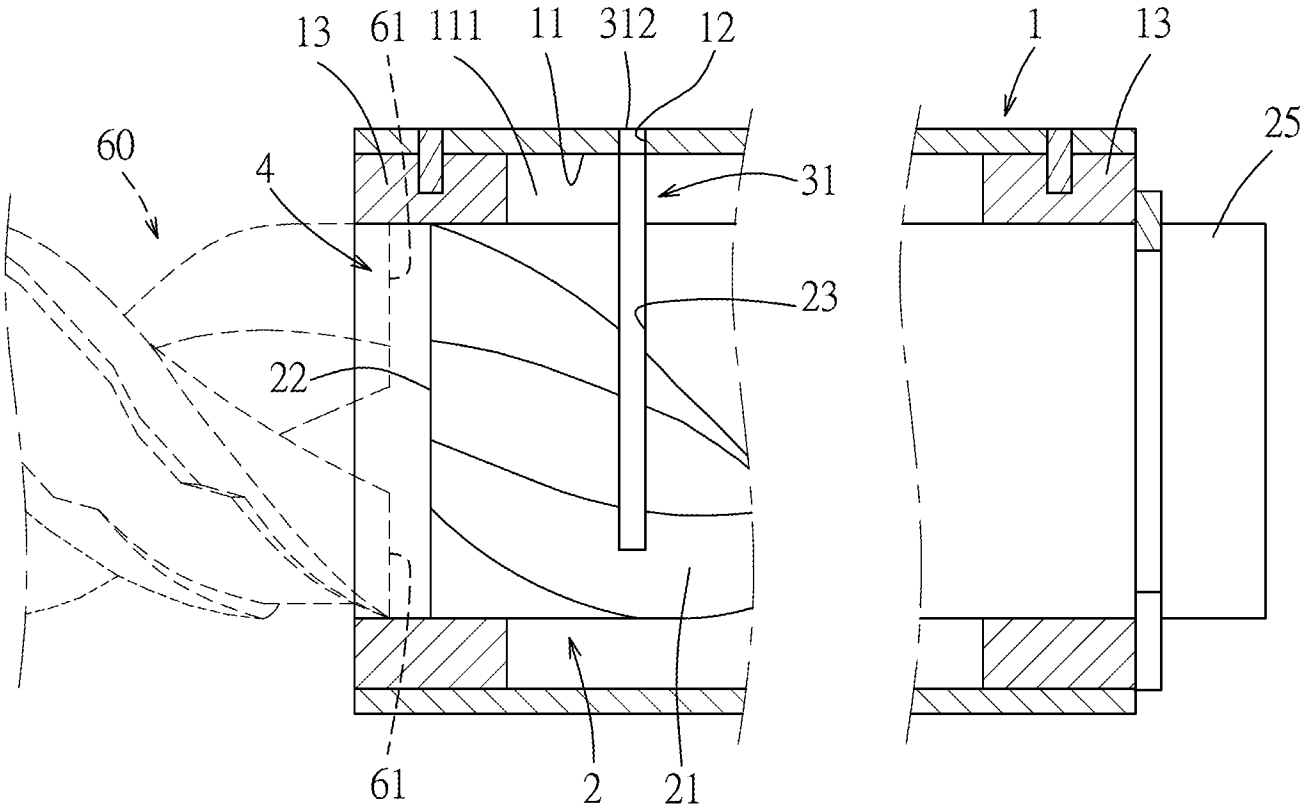
FIG. 2 is a fragmentary sectional view of a lock of the embodiment.

Referring further to FIG. 2, the lock 100 includes a housing 1, a cylindrical core 2 and three tumbler units 3. The housing 1 includes a tubular housing body 10 and a pair of positioning rings 13. The housing body 10 has an inner surrounding surface 11 that defines an inner space 111, and three limiting grooves 12 (only two are visible in FIG. 1) that are formed in the inner surrounding surface 11, and that communicate spatially with the inner space 111. The positioning rings 13 are mounted in the housing body 10, and are disposed respectively at opposite ends of the inner space 111.

The cylindrical core 2 extends along a core axis (A), and is inserted into both of the positioning rings 13 for being positioned relative to the housing body 10 of the housing 1. The cylindrical core 2 is rotatable relative to the housing 1 about the core axis (A), and has an insertion end 22, a mount end 25, two helical keyways 21, three retaining grooves 23 and three installation grooves 24.

The insertion end 22 is retained in one of the positioning rings 13, and cooperates with the one of the positioning rings 13 to define an insertion groove 4. The mount end 25 is opposite to the insertion end 22 along the core axis (A), and is disposed outwardly of the housing 1 for being mounted with a latch piece (not shown).

The helical keyways 21 are formed in an outer surrounding surface of the cylindrical core 2, and are angularly spaced apart from each other about the core axis (A). Each of the helical keyways 21 extends through the insertion end 22 of the cylindrical core 2 to form an opening of the insertion end 22 (i.e., the insertion end 22 is formed with two openings corresponding respectively to the helical keyways 21).

The retaining grooves 23 are formed in the outer surrounding surface of the cylindrical core 2, and are spaced apart from each other along the core axis (A). Each of the retaining grooves 23 extends in the circumferential direction of the cylindrical core 2, and communicates spatially with both of the helical keyways 21.

The installation grooves 24 are formed in the outer surrounding surface of the cylindrical core 2, and correspond respectively to the retaining grooves 23. Each of the installation grooves 24 extends in the radial direction of the cylindrical core 2, and communicates spatially with the corresponding one of the retaining grooves 23.

The tumbler units 3 are mounted to the cylindrical core 2, and correspond respectively to the retaining grooves 23. For simplification, one of the tumbler units 3 will be described in the following.

Figure 3:
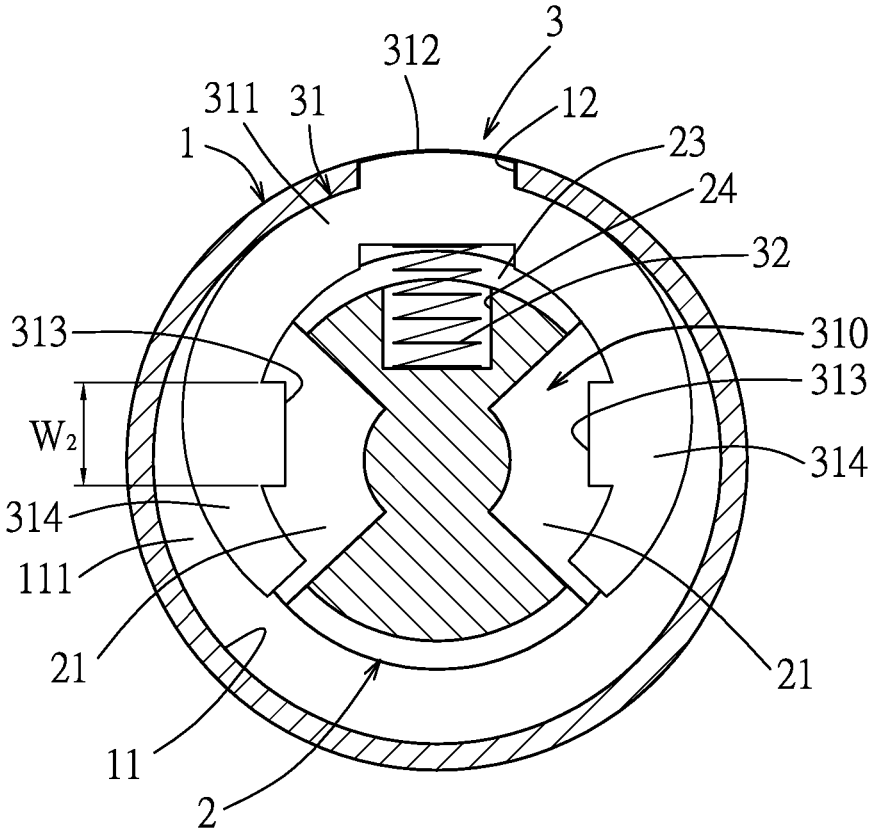
FIG. 3 is a sectional view of the lock of the embodiment illustrating a limiting member being at an engaged position.
Figure 6:
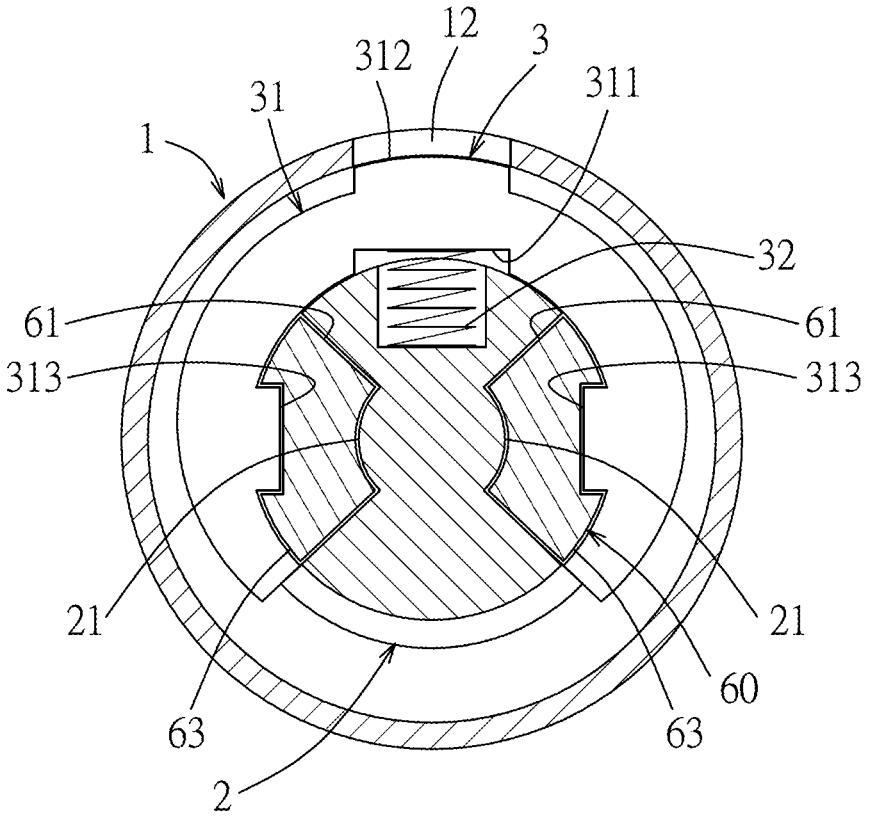
FIG. 6 is a sectional view of the embodiment illustrating the key being inserted into the lock, and the limiting member being at the disengaged position.

The tumbler unit 3 includes a limiting member 31 and a resilient member 32. The limiting member 31 is movable relative to the cylindrical core 2 along a limiting axis (L) of the cylindrical core 2, and has a main body 311, a limiting projection 312 and two guide blocks 313. In this embodiment, the limiting axis (L) extends in the radial direction of the cylindrical core 2. The main body 311 extends into the correspond one of the retaining grooves 23 such that the limiting member 31 is prevented from moving along the core axis (A) relative to the cylindrical core 2. The limiting projection 312 projects away from the cylindrical core 2 from the main body 311, and is aligned with a respective one of the limiting grooves 12 of the housing 1 in the radial direction of the cylindrical core 2 when the cylindrical core 2 is at a locked position relative to the housing 1 (see FIGS. 3 and 6). The main body 311 is C-shaped, and has two driven sections 314 extending respectively into the helical keyways 21, and cooperatively defining an extending space 310 therebetween. Each of the guide blocks 313 projects from a respective one of the driven sections 314 and into the extending space 310.

When the cylindrical core 2 is at the locked position, the limiting member 31 is movable in the radial direction of the cylindrical core 2 between an engaged position (see FIG. 3), where the limiting projection 312 engages fittingly the respective one of the limiting grooves 12 to prevent the relative rotation between the cylindrical core 2 and the housing 1, and a disengaged position (see FIG. 6), where the limiting projection 312 is disengaged from the respective one of the limiting grooves 12 to permit the relative rotation between the cylindrical core 2 and the housing 1. In this embodiment, the positioning rings 13 define an annular gap between the housing body 10 and the cylindrical core 2 for permitting the radial movement of the limiting member 31 of each of the tumbler units 3.

The resilient member 32 is installed in the installation groove 24 corresponding to the corresponding one of the retaining grooves 23, and has opposite ends abutting respectively against the limiting member 31 and the cylindrical core 2 for biasing resiliently the limiting member 31 away from the cylindrical core 2. That is, the resilient member 32 biases resiliently the limiting member 31 to the engaged position to prevent the relative rotation between the cylindrical core 2 and the housing 1 when the cylindrical core 2 is at the locked position. In this embodiment, the resilient member 32 is configured as a compression spring.

The key 600 has a blade section 60, a grip section for being held, and a connecting section 64 interconnecting the blade section 60 and the grip section 66.

The blade section 60 has a double-helix structure that includes two helical blades 61 corresponding respectively to the helical keyways 21 of the cylindrical core 2. Each of the helical blades 61 has an outer helical surface 63 that extends in an extending direction of the helical blade 61, and that faces radially and outwardly to serve as a guide surface, and a continuous guide groove 65 that is formed in the outer helical surface 63.

Figure 4:
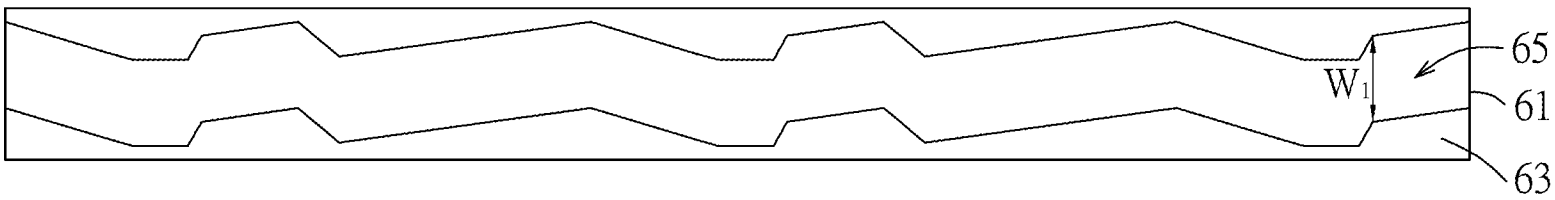
FIG. 4 is a schematic view of a stretched guide groove of a key of the embodiment.

Referring to FIG. 4, to clearly describe, one of the helical blades 61 is unrolled and stretched. The guide groove 65 of the helical blades 61 substantially extends along the outer helical surface 63 of the helical blade 61. At least a portion of the guide groove 65 does not extend in the helically-extending direction of the outer helical surface 63.

Each of the helical blades 61 is able to be inserted fittingly into the corresponding one of the helical keyways 21 via the corresponding opening to access the corresponding driven section 314 of the limiting member 31 of each of the tumbler units 3 extending into the corresponding helical keyway 21. It is noted that the width (w1) (see FIG. 4) of the guide groove 65 of each of the helical blades 61 is equal to or greater than the width (w2) (see FIG. 3) of the corresponding guide block 313 of the limiting member 31 of each of the tumbler units 3 disposed in the corresponding helical keyway 21.

Initially, the cylindrical core 2 is at the locked position, and the limiting member 312 of each of the tumbler unit 3 is at the engaged position to prevent the relative rotation between the cylindrical core 2 and the housing 1. At this time, the latch piece is retained in a locking groove (not shown).

Referring to FIG. 2, to remove the latch piece from the locking groove, the blade section 60 of the key 600 is first inserted into the insertion groove 4, and is therefore limited to rotate within the insertion groove 4 until distal ends of the helical blades 61 are respectively registered with the openings of the insertion end 22 of the cylindrical core 2.

Figure 5:
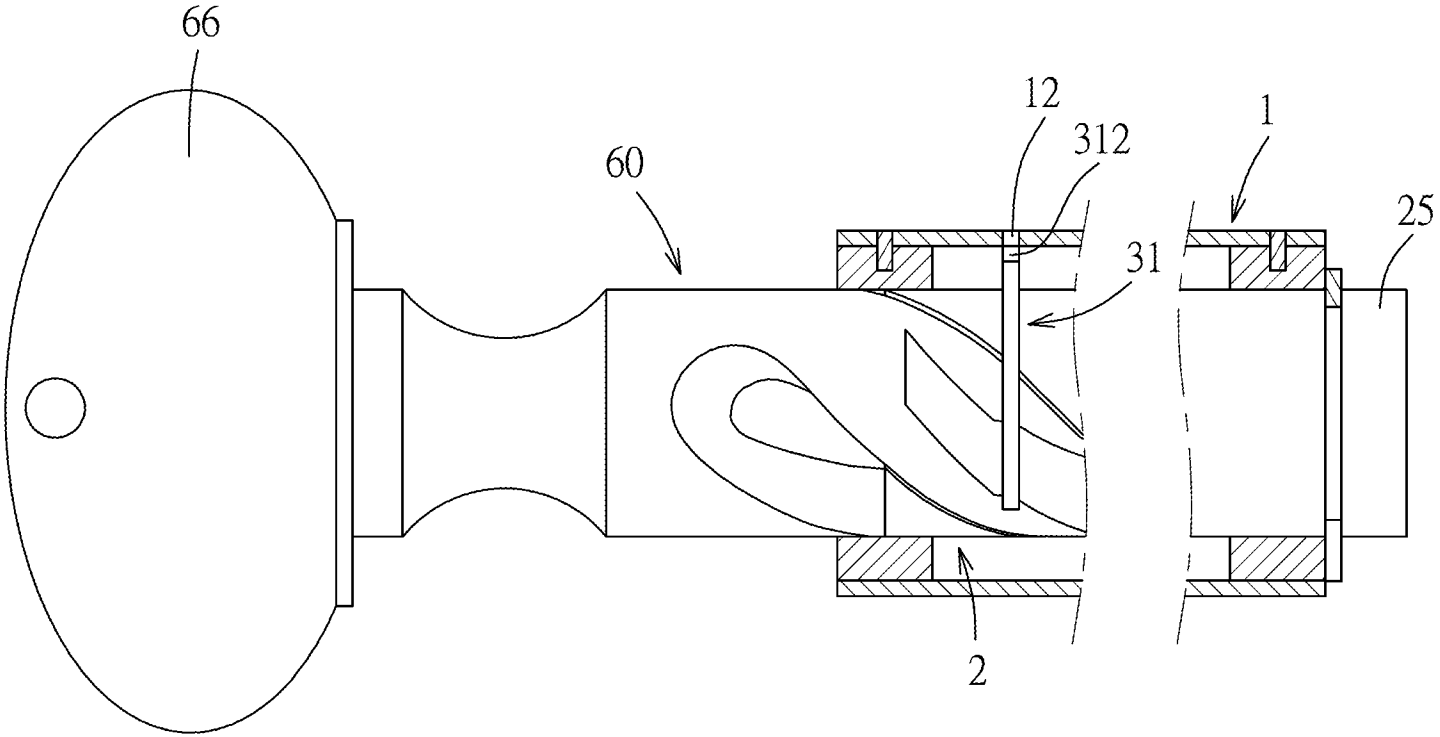
FIG. 5 is a schematic view of the embodiment illustrating the key being inserted into the lock, and the limiting member being at a disengaged position.

Then, the helical blades 61 are inserted respectively into the helical keyways 21 and through the extending space 310 of the limiting member 31 of each of the tumbler units 3, and the guide grooves 65 of the helical blades 61 are engaged slidably and respectively with the guide blocks 313 of the limiting member 31 of each of the tumbler units 3. Referring to FIG. 5, during the insertion movement of the blade section 60, the limiting members 31 of the tumbler units 3 are in turn driven to move in the radial direction of the cylindrical core 2 between the engaged position and the disengaged position. Two groove-defining surfaces of the blade section 60 that respectively define the guide grooves 65 of the helical blades 61 are configured to drive all of the limiting members 31 to move to the disengaged position when the helical blades 61 are completely and respectively inserted into the keyways 21. As a result, the latch piece can be removed from the locking groove by turning the grip section 66 of the key 600 to rotate the cylindrical core 2 relative to the housing 1.

To drive the latch piece back to engage the locking groove, the grip section 66 of the key 600 is turned to drive rotation of the cylindrical core 2 relative to the housing 1. It is noted that, the limiting projection 312 of each of the tumbler units 3 is misaligned with the corresponding limiting groove 12 when the cylindrical core 2 leaves the locked position, so that the limiting projection 312 of each of the tumbler units 3 abuts against the inner surrounding surface 11 of the housing body 10 to prevent the radial movement of the limiting member 31 of the tumbler units 3, and to thereby limit the movement of the blade section 60 along the core axis (A) relative to the cylindrical core 2 until the cylindrical core 2 is rotated back to the locked position, where the latch piece engages the locking groove, and at least one of the limiting members 31 moves back to the engaged position. Then, the relative rotation between the cylindrical core 2 and the housing 1 is prevented, and the helical blades 61 of the blade segment 60 can be driven to disengage respectively from the helical keyways 21.

It is noted that the lock 100 may include less than three or more than three tumbler units 3, and the cylindrical core 2 correspondingly has the same number of the retaining grooves 23 and the same number of the installation grooves 24 for being mounted respectively with the tumbler units 3. Therefore, the configuration of the guide groove 65 of each of the helical blades 61 needs to be modified according to the number of the tumbler units 3. Moreover, the blade segment 60 of the key 600 may include only one or more than two helical blades 61, and the cylindrical core 2 correspondingly has one or more than two helical keyways 21. The limiting member 31 of each of the tumbler units 3 may therefore have at least one driven section 314 that extends into one of the helical keyways 21 to be driven when the helical blades 61 are inserted respectively into the helical keyways 21.

It is further noted that each of the helical blades 61 is adjustable in geometry and shape, such as cross-sectional area, thickness, angle and extending direction, with the helical keyways 21 being correspondingly modified. The locations of the tumbler units 3 are also adjustable with the configuration of the guide groove 65 of each of the helical blades 61 being correspondingly modified.

To sum up, the lock 100 of the locking device of this invention has the helical keyways 21 and the limiting members 31 each extending into the helical keyways 21 to be driven. Since a picking tool must be inserted into at least one of the helical keyways 21 to access all of the limiting members 31 and to drive movements of all of the limiting members 31, it is difficult to pick the lock 100 unless the picking tool is configured like the helical blade 61 of the key 600 of this invention.

While the present invention has been described in connection with what is considered the most practical embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A locking device comprising:

a lock including a housing that includes a housing body, said housing body having an inner surrounding surface that defines an inner space, and a limiting groove that is formed in said inner surrounding surface, a cylindrical core that extends along a core axis into said housing, that is rotatable relative to said housing about the core axis, and that has an insertion end, a helical keyway and a retaining groove, said insertion end being retained in said inner space of said housing body, said helical keyway being formed in an outer surrounding surface of said cylindrical core, and extending through said insertion end to form an opening of said insertion end, said retaining groove being formed in said outer surrounding surface of said cylindrical core, and a tumbler unit that includes a limiting member and a resilient member, said limiting member being mounted to said cylindrical core, being movable relative to said cylindrical core along a limiting axis of the cylindrical core, and having a main body and a limiting projection, said main body extending into said retaining groove and having a driven section that extends into said helical keyway, said limiting projection projecting away from said cylindrical core, and being aligned with said limiting groove in the direction of the limiting axis when said cylindrical core is at a locked position, said limiting projection engaging fittingly said limiting groove to prevent the relative rotation between said cylindrical core and said housing when said limiting member is at an engaged position, said limiting projection being disengaged from said limiting groove to permit the relative rotation between said cylindrical core and said housing when said limiting member is at a disengaged position, said resilient member abutting against said limiting member for biasing resiliently said limiting member to the engaged position when said cylindrical core is at the locked position, so as to prevent the relative rotation between said cylindrical core and said housing; and a key having a grip section for being held, and a blade section that is connected to said grip section, and that includes a helical blade, said helical blade being capable of being inserted into said helical keyway via said opening of said insertion end of said cylindrical core to access said driven section of said limiting member when said cylindrical core is at the locked position, so as to drive movement of said limiting member to the disengaged position to permit the relative rotation between said cylindrical core and said housing.

2. The locking device as claimed in claim 1, wherein:

said helical blade of said key has a helically-extending guide surface, and a continuous guide groove that is formed in said guide surface, and that substantially extends along said guide surface, at least a portion of said guide groove being configured not to extend in the helically-extending direction of said guide surface; and said limiting member further has a guide block that projects from said driven section of said main body and that engages slidably said guide groove when said helical blade is inserted into said helical keyway, such that said limiting member is driven to move along the limiting axis by a groove-defining surface that defines said guide groove during the insertion movement of said helical blade of said key.

3. The locking device as claimed in claim 2, wherein said helical blade has an outer helical surface that faces radially and outwardly, and that serves as said guide surface.

4. The locking device as claimed in claim 1, wherein:

said blade section of said key has a multiple-helix structure that includes a plurality of said helical blades;

said cylindrical core has a plurality of said helical keyways that correspond respectively to said helical blades, each of said helical keyways extending through said insertion end of said cylindrical core for insertion of a respective one of said helical blades, and a plurality of said retaining grooves that are spaced apart from each other along the core axis;

said lock includes a plurality of said tumbler units corresponding respectively to said retaining grooves, each of said tumbler units including one said limiting member that is movable relative to said cylindrical core in a radial direction of the cylindrical core, and that has one said main body extending into a corresponding one of said retaining grooves, and one said limiting projection, said main body having at least one said driven section that extends into one of said helical keyways for being accessed when said helical blades are inserted respectively into said helical keyways, and one said resilient member for biasing resiliently said limiting member away from said cylindrical core in the radial direction of said cylindrical core; and said housing body has a plurality of said limiting grooves, each of said limiting grooves being engageable with said limiting projection of said limiting member of a respective one of said tumbler units when said cylindrical core is at the locked position.

5. The locking device as claimed in claim 1, wherein said retaining groove of said cylindrical core extends in a circumferential direction of said cylindrical core.

6. The locking device as claimed in claim 1, wherein said cylindrical core further has an installation groove that is formed in said outer surrounding surface of said cylindrical core, said resilient member of said tumbler unit being installed in said installation groove and having opposite ends that abut respectively against said cylindrical core and said limiting member.

7. The locking device as claimed in claim 1, wherein said housing of said lock further includes a pair of positioning rings each being mounted between said housing body and said cylindrical core for positioning said cylindrical core relative to said housing body, said insertion end of said cylindrical core being inserted into one of said positioning rings, and cooperating with the one of said positioning rings to define an insertion groove for insertion of said key.

8. A lock comprising:

a housing including a housing body that has an inner surrounding surface defining an inner space, and a limiting groove formed in said inner surrounding surface;

a cylindrical core extending along a core axis into said housing, rotatable relative to said housing about the core axis, and having an insertion end that is retained in said inner space of said housing body, a helical keyway that is formed in an outer surrounding surface of said cylindrical core, and that extends through said insertion end to form an opening of said insertion end, and a retaining groove that is formed in said outer surrounding surface of said cylindrical core; and a tumbler unit including a limiting member that is mounted to said cylindrical core, that is movable relative to said cylindrical core along a limiting axis of the cylindrical core, and that has a main body and a limiting projection, said main body extending into said retaining groove and having a driven section that extends into said helical keyway, said limiting projection projecting away from said cylindrical core, and being aligned with said limiting groove in the direction of the limiting axis when said cylindrical core is at a locked position, said limiting projection engaging fittingly said limiting groove to prevent the relative rotation between said cylindrical core and said housing when said limiting member is at an engaged position, said limiting projection being disengaged from said limiting groove to permit the relative rotation between said cylindrical core and said housing when said limiting member is at a disengaged position, and a resilient member that abuts against said limiting member for biasing resiliently said limiting member to the engaged position when said cylindrical core is at the locked position, so as to prevent the relative rotation between said cylindrical core and said housing;

wherein a blade member is capable of being inserted into said helical keyway via said opening of said insertion end of said cylindrical core to access said driven section of said limiting member when said cylindrical core is at the locked position, so as to drive movement of said limiting member to the disengaged position to permit the relative rotation between said cylindrical core and said housing.

9. The lock as claimed in claim 8 adapted for use with a key, the key having a helical blade that has a helically-extending guide surface and a continuous guide groove, the guide groove being formed in the guide surface, and substantially extending along the guide surface, at least a portion of the guide groove being configured not to extend in the helically-extending direction of the guide surface, wherein, said limiting member further has a guide block that projects from said driven section of said main body and that is adapted to engage slidably the guide groove when the helical blade is inserted into said helical keyway, such that said limiting member is driven to move along the limiting axis by a groove-defining surface of the helical blade that defines the guide groove during the insertion movement of the helical blade.

10. The lock as claimed in claim 8 adapted for use with a key, the key having a multiple-helix structure that includes a plurality of helical blades, wherein:

said cylindrical core has a plurality of said helical keyways that correspond respectively to the helical blades, each of said helical keyways extending through said insertion end of said cylindrical core for insertion of a respective one of the helical blades, and a plurality of said retaining grooves that are spaced apart from each other along the core axis;

said lock includes a plurality of said tumbler units corresponding respectively to said retaining grooves, each of said tumbler units including one said limiting member that is movable relative to said cylindrical core in a radial direction of the cylindrical core, and that has one said main body extending into a corresponding one of said retaining grooves, and one said limiting projection, said main body having at least one said driven section extending into one of said helical keyways for being accessed when the helical blades are inserted respectively into said helical keyways, and one said resilient member for biasing resiliently said limiting member away from said cylindrical core in the radial direction of said cylindrical core; and said housing body has a plurality of said limiting grooves, each of said limiting grooves being engageable with said limiting projection of said limiting member of a respective one of said tumbler units when said cylindrical core is at the locked position.

11. The lock as claimed in claim 8, wherein said retaining groove of said cylindrical core extends in a circumferential direction of said cylindrical core.

12. The lock as claimed in claim 8, wherein said cylindrical core further has an installation groove that is formed in said outer surrounding surface of said cylindrical core, said resilient member of said tumbler unit being installed in said installation groove and having opposite ends that abut respectively against said cylindrical core and said limiting member.

13. The lock as claimed in claim 8, wherein said housing of said lock further includes a pair of positioning rings each being mounted between said housing body and said cylindrical core for positioning said cylindrical core relative to said housing body, said insertion end of said cylindrical core being inserted into one of said positioning rings, and cooperating with the one of said positioning rings to define an insertion groove for insertion of a key.

14. A key adapted for use with a lock, the lock including a housing, a cylindrical core that extends rotatably into the housing and that has a helical keyway, and a limiting member that is mounted movably between the housing and the cylindrical core, the limiting member having a driven section that extends into the helical keyway and a guide block that projects from the driven section, and being movable between an engaged position where the relative rotation between the housing and the cylindrical core is prevented, and a disengaged position where the relative rotation between the housing and the cylindrical core is permitted, said key comprising:

a grip section for being held; and a blade section connected to said grip section and including a helical blade, said helical blade being adapted to be inserted into the helical keyway to access the driven section of the limiting member, so as to drive movement of the limiting member to the disengaged position to permit the relative rotation between the housing and the cylindrical core;

wherein, said helical blade of said key has a helically-extending guide surface, and a continuous guide groove that is formed in said guide surface, and that substantially extends along said guide surface, at least a portion of said guide groove being configured not to extend in the helically-extending direction of said guide surface, the guide block engaging slidably said guide groove when said helical blade is inserted into the helical keyway, such that the limiting member is moved by a groove-defining surface that defines said guide groove during the insertion movement of said helical blade of said key.

15. The key as claimed in claim 14, wherein said helical blade has an outer helical surface that faces radially and outwardly, that defines a side of said guide groove, and that serves as said guide surface.

16. The key as claimed in claim 14, the cylindrical core of the lock having a plurality of helical keyways, wherein said blade section of said key has a multiple-helix structure including a plurality of said helical blades that are adapted to be inserted respectively into the helical keyways to access the driven section of the limiting member.

* * * * *